US008230943B2

(12) United States Patent
Felger

(10) Patent No.: US 8,230,943 B2
(45) Date of Patent: Jul. 31, 2012

(54) ELECTRICAL TOOL WITH GEAR SWITCHING

(75) Inventor: Reiner Felger, Korb (DE)

(73) Assignee: AEG Electric Tools GmbH, Winnenden (DE)

( * ) Notice: Subject to any disclaimer, the term of this patent is extended or adjusted under 35 U.S.C. 154(b) by 186 days.

(21) Appl. No.: 12/509,402

(22) Filed: Jul. 24, 2009

(65) Prior Publication Data

US 2010/0025059 A1 Feb. 4, 2010

(30) Foreign Application Priority Data

Jul. 25, 2008 (EP) ..... 08161170

(51) Int. Cl.
*E02D 7/02* (2006.01)
*B25C 5/02* (2006.01)
*B25C 5/06* (2006.01)

(52) U.S. Cl. ..... 173/48; 227/118

(58) Field of Classification Search ..... 173/48, 173/47, 91, 93.6; 227/107–120
See application file for complete search history.

(56) References Cited

U.S. PATENT DOCUMENTS

| | | | | |
|---|---|---|---|---|
| 5,415,240 | A * | 5/1995 | Mundjar | 173/48 |
| 6,171,312 | B1 * | 1/2001 | Beaty | 606/80 |
| 6,971,455 | B2 * | 12/2005 | Shibata et al. | 173/48 |
| 6,988,563 | B2 * | 1/2006 | Hashimoto et al. | 173/48 |
| 7,328,752 | B2 * | 2/2008 | Gass et al. | 173/2 |
| 7,395,873 | B2 * | 7/2008 | Nakamura et al. | 173/93.5 |
| 7,677,752 | B2 * | 3/2010 | Tadokoro et al. | 362/119 |
| 7,708,084 | B2 * | 5/2010 | Duesselberg et al. | 173/48 |
| 7,753,135 | B2 * | 7/2010 | Lennartz | 173/109 |
| 2006/0137888 | A1 * | 6/2006 | Soika et al. | 173/48 |
| 2008/0164041 | A1 * | 7/2008 | Hess et al. | 173/109 |
| 2008/0169111 | A1 * | 7/2008 | Duesselberg et al. | 173/48 |
| 2009/0145617 | A1 * | 6/2009 | Duesselberg et al. | 173/48 |
| 2010/0051303 | A1 * | 3/2010 | Ullrich et al. | 173/48 |

FOREIGN PATENT DOCUMENTS

| | | | |
|---|---|---|---|
| EP | 1944132 | A | 7/2008 |
| JP | 09070771 | A * | 3/1997 |
| JP | 90700771 | A | 3/1997 |
| JP | 9272005 | A | 10/1997 |
| WO | WO 2007-060043 | A | 5/2007 |

OTHER PUBLICATIONS

European Search Report; Application No. 08161170.0 dated Jan. 5, 2009.
English translation of Office Action date Jan. 31, 2012 for Chinese Patent Application No. 200910157346.1.

* cited by examiner

*Primary Examiner* — Rinaldi Rada
*Assistant Examiner* — Robert Long
(74) *Attorney, Agent, or Firm* — Knobbe Martens Olson & Bear LLP

(57) ABSTRACT

An electrical tool, in particular drill and chiselling hammer, including a drive shaft and two driven members. The drive shaft is operatively connectable with the driven members by a respective one of a pair of coupling sleeves. The coupling sleeves are actuatable by a rotatable and mechanical actuating element, in particular a mechanical rotary switch. The actuating element of the electrical tool includes transmission features or a transmission portion that is stationary with respect to the actuating element and which is contactable directly with the respective coupling sleeve for actuating the coupling sleeves.

14 Claims, 4 Drawing Sheets

ELECTRICAL TOOL WITH GEAR SWITCHING

RELATED APPLICATIONS

This application claims priority to European Patent Application No. EP-08 161 170.9, filed Jul. 25, 2008, entitled ELECTRICAL TOOL WITH GEAR SWITCHING, the entirety of which is incorporated by reference herein.

BACKGROUND OF THE INVENTION

1. Field of the Invention

The invention is directed towards an electrical tool, in particular a drill and chipping hammer having a drive shaft and two driven members, wherein the drive shaft can be operatively connected with the individual driven members by means of a coupling sleeve. The coupling sleeve can be operated by a mechanical actuating element, in particular by a mechanical rotary switch.

2. Description of the Related Art

Electrical tools, such as drill and chipping hammers, in which a motion of the drive shaft is transmitted to driven members are mostly provided with a coupling device that enables coupling and decoupling between the drive shaft and the driven members in order to transmit power. For example, the driven members should not be coupled with the drive shaft in every operating condition of the electrical tool. In this case it is also necessary that the flow of force (power transmission) between the drive shaft and the corresponding driven member can be interrupted.

In order to operate corresponding coupling elements, rotary switches are often used to allow a user to choose between two or three operating modes of the electrical tool. As the coupling elements are mostly operated by a translational motion, a diverting mechanism is necessary in this case, which translates the rotational motion of the rotary switch into a translational motion of the coupling elements.

In a drill and chiselling hammer, a corresponding diverting mechanism is usually formed by means of a switching slider that it movable by corresponding guide rails along the actuating direction of the coupling elements. In order to allow a plurality of operating modes of an electrical tool having two separate couplings, the mentioned switching slider is often based upon a complicated mechanical structure which translates the rotational motion of the rotary switch in corresponding translational motions and directions of the corresponding coupling elements.

A disadvantage of such a configuration of an electrical tool consists in the switching slider being formed by a complex component or arrangement. Moreover, the additional component requires a certain amount of space. in the housing and renders more complicated the manufacture of the electrical tool.

SUMMARY OF THE INVENTION

It is an object of the present invention to design an electrical tool of the above-mentioned technical field, comprising a straight-forward mechanism for actuating the coupling and allowing a simple locking of at least one of the driven members.

A solution to one or more of the above problems is provided by the features of the claimed electrical tools. According to embodiments of the present invention, the actuating element comprises a transmission means stationary with respect to the actuating elements and which is directly contactable with the corresponding coupling sleeve for actuation thereof. The transmission means is, thus, an element fixedly installed on the actuating elements and acting immediately, that is without additional diverting or guiding mechanisms, onto the coupling sleeve. In such a configuration of the actuating element, in which a transmission means comprising the above features is provided, a complicated structure of the switching slider or similar components may be dispensed with. By omitting such a component, the entire electrical tool may be constructed in a simpler manner and the housing may be made slimmer.

Moreover, there is no further need for a guiding rail or other guiding element for the switching slider, and the electrical tool is operatively more secure in the direct transmission of the actuation of the gear switching mechanism on the coupling sleeve as compared to an electrical tool having a switching slider. In a corresponding configuration of the actuating element it is further possible to implement the actuating element as mechanical rotary switch so that the operability of the electrical tool in comparison to common electrical tools is maintained.

Preferably, the coupling sleeves are supported in an axially displaceable manner on the drive shaft. In such an embodiment, an additional guide for each of the coupling sleeves can be dispensed with. Moreover, the coupling sleeves, which are supported on the drive shaft in an axially displaceable manner, on the one hand allow a simpler force transmission by means of a direct coupling between the coupling sleeves and the drive shaft, and on the other hand this coupling can also be easily interrupted by an axial displacement relative to the drive shaft. The coupling mechanism between the drive shaft and the corresponding driven member by means of the coupling sleeve is, thus, particularly easy to realize with a correspondingly supported coupling sleeve.

Advantageously, the driven members are supported on the drive shaft in a free-wheeling manner so that the drive shaft can move independently of and is surrounded by the driven members. Moreover, in this way it is particularly straightforward to allow the flow of force to arise between the coupling sleeves and the driven members if also the coupling sleeves are supported on the drive shaft.

Preferably, the coupling sleeves are formed for creating a form-fit operative connection (e.g., an interlocking connection) between the drive shaft and the driven members. Thus, a particularly secure and low-wear force transmission between the drive shaft and the individual driven member is ensured. Alternatively, it is also possible for the coupling sleeves to create a force-fit connection (e.g., a friction connection) between the drive shaft and the individual driven member. In the preferred embodiments, the flow of force runs, however, both from the drive shaft to the coupling sleeve and from the coupling sleeve to the individual driven member by means of form-fit. This force transmission is particularly low-wear.

In a further preferred embodiment, the coupling sleeves are loaded in the direction of a respective first position, in which the drive shaft and the individual driven member are operatively connected to each other, preferably by a spring load, wherein the respective first positions are preferably axially opposite to each other. In this preferred embodiment a spring load, for example, thus acts upon each of the coupling sleeves and presses these in a direction of the coupled position in which the drive shaft is coupled with the individual driven elements. This means that a force opposed to the load has to be applied to the coupling sleeves to be operated by means of the actuating element and via the transmission means. Thus, in this preferred embodiment, a decoupling of the coupling sleeve is caused by the actuating element, which otherwise would always remain coupled due to the load. In the particularly preferred embodiment, in which the respective first positions of the coupling sleeve are axially opposite to each other, a single spring member extending between the coupling sleeves may be used for loading both coupling sleeves. In this case, each of the coupling sleeves is supported against the other one of the coupling sleeves by the spring member. Consequently, this results in a further simplification of the housing as no separate stopper for the spring member needs to be present.

Further it is preferred that the coupling sleeves are each positionable, via the transmission means through the actuation elements, in a second position in which the drive shaft and the corresponding driven member are not operatively connected. In this preferred embodiment, the coupling sleeve may thus each be brought into a position by means of the actuating element so that the coupling sleeve interrupts the flow of force between the drive shaft and the corresponding driven member. This second position in which the corresponding driven member is thus decoupled may in a particularly preferred manner be occupied by shifting a first coupling sleeve in direction of the second coupling sleeve.

Preferably, the transmission means may selectively be brought in direct contact with one of the coupling sleeves. For example, this may be rendered possible by having a single transmission means in a first position directly contact the first coupling sleeve and, in a second position, be in direct contact with the second coupling sleeve. To that end, the coupling means may, for example, establish a sliding contact with the corresponding coupling sleeve. Thereby, the coupling sleeve can be displaced in a first direction by means of the transmission means, and may be displaceable relative to the transmission means in a second direction not parallel to the first one. In particular it is possible that the coupling sleeve rotates relative to the transmission means. A direct contact of the transmission means with the coupling sleeve may for example be already achieved by directly abutting the transmission means to the corresponding coupling sleeve.

In a preferred embodiment, the transmission means is formed by at least one projection, preferably two projections, wherein the projection preferably extends in a direction parallel to the rotational axis of the actuating element. Such a projection is a particularly simple embodiment of a transmission means, wherein the projection advantageously extends on the rotatable mechanic actuating element over an arc of an angle range of at least 45°, or in the preferred case of two projections, a first projection is attached at a first angle portion of the actuating element and a second projection is attached at a second angle portion of the actuating element, wherein the second angle portion is angularly distanced from the first angle portion by at least 45°. In the preferred case of forming the transmission means by two projections, each of the two projections can be brought into contact with one of the coupling sleeves and, thus, the path around which the mechanical actuating element rotates in order to contact a respective coupling sleeve is shortened. Advantageously, the projection extends in a direction parallel to the rotational axis of the actuating element so that upon operating the actuating element it is moved in constant alignment around the rotational axis of the actuating element.

Preferably, the projection is formed by a pin which, in a particularly preferred manner, is integrally formed with the actuating element. A pin in the actuating element is a particularly simple embodiment of the projection, but alternatively an elongated arc portion may be provided as continuous projection, too. If the projection is realized by a pin, this may be connected with the actuating element in a particularly simple manner. A separate pin, for instance made of metal, may very preferably be incorporated into a corresponding actuating element, for example pressed, screwed or otherwise fitted therein. In contrast, in the case of an integral (unitary) implementation of the projection with the actuating element, there is the advantage that the number of parts to be used is reduced and the production effort as well as the associated costs may further be reduced. However, it is to be observed that due to the high frictional force between the projection and the coupling sleeve a heat-resistant implementation of both components is important in order to avoid rapid wear of these elements.

At least one of the driven members is, according to the invention, lockable against a rotational motion by means of a locking device. If the respective driven member is decoupled from the motion of the drive shaft by means of the actuating element, it is possibly not desired that the decoupled driven member may freely move around its rotational axis. In order to restrict such a movement, the locking device is provided which locks the driven member against rotational motion. The locking device is utilized in the above-mentioned case in which the driven member is decoupled from the motion of the drive shaft.

Preferably, the actuating element is formed so as to select from three different coupling states between the drive shaft and the two driven members. The three different coupling states may consist in that, on the one hand, only the first driven member is driven by the drive shaft, further that only the second member is driven by the drive shaft, and moreover that both driven members are concurrently driven by the drive shaft. However, it is also conceivable that the actuating element may be utilized for choosing only two different coupling states.

Preferably, the rotational axis of the actuating element runs substantially in parallel to the radial axis of the drive shaft. By this alignment of the rotational axis of the actuating element a particularly space-saving and efficient combination of the actuating element with the transmission means and the coupling sleeves to be contacted is possible. Here, it is preferred that the rotational axis of the actuating element is not exactly situated on a radial axis of the drive shaft but is displaced running in parallel thereto. The precision of the parallelism between the rotational axis of the actuating element and the respective radial axis of the drive shaft may be in a range of ±10°.

In a preferred embodiment in which the projection extends in parallel to the rotational axis of the actuating element, the projection further extends in one of the contact positions with one of the coupling sleeves substantially along an axis running radially with respect to the drive shaft. In such an embodiment and in this state, the projection of the actuating element occupying one of the contact positions is situated on an axis running radially with respect to the drive shaft. This arrangement of the projection allows for a particularly advantageous actuation of the respective coupling sleeve by means of the projection of the actuating element. The precision of alignment of the projection with respect to the axis running radially with respect to the drive shaft may also be in a range of ±10°, wherein the position of the projection with respect to the axis running radially to the drive shaft has to be maintained with a precision of two diameters of the projection on both sides of the axis, respectively.

Advantageously, the driven members are a countershaft (layshaft) gear and a tumble drive.

Preferably, the actuating element alternatively switches between a first state in which the electrical tool performs a rotational motion of the countershaft gear, and a second state in which the electrical tool performs a motion of the tumble drive, wherein the countershaft gear is rotationally fixed, and a third state in which the electrical tool performs a simultaneous motion of the countershaft gear and the tumble drive. Here, it is not necessary that the countershaft gear is rotationally fixed. In the second state, it can also rotate freely. However, it is preferred that the countershaft gear is rotationally fixed in this state.

In the electrical tool according to embodiments of the invention, the mechanical actuating element is in contrast to an electronic actuating device. However, it is also possible that a mechanical actuating element having the inventive features is moved by means of an electronic actuating device. However, it is preferred that the actuating element is actuated directly, that is immediately by hand, by a user. The actuation of the coupling sleeves by means of the mechanical actuating element means that each of the couplings is decoupled upon actuation. In the not actuated state each of the couplings ensures a flow of force from the drive shaft to the respective driven member; this flow of force is only interrupted upon actuation. The property of the transmission means to be stationary with respect to the actuating elements means in particular that the transmission means is fixed on the actuating element. As an example for a corresponding transmission means a pin fitted into the actuating element is mentioned, although other elements may be suitable as transmission means, too. The central feature of the transmission means to be directly, that is immediately, contactable with the respective coupling sleeve for actuating a coupling sleeve, means that there is no rodding (linkage), deflecting (bypass) element or similar intermediate elements such as guides etc. between the transmission means situated stationary on the actuating element and the respective coupling sleeve. Rather, the transmission means directly contacts the respective coupling sleeve.

Apart from the mentioned form-fit operative connection between the drive shaft and the driven members, a (partial) force-fit operative connection between the mentioned elements is possible, too. It is also conceivable that only one power transmission at the respective coupling sleeve is effected by force-fit, and the other power transmission occurs by form-fit. For example, the power transmission between the drive shaft and the respective coupling sleeve may be effected by a form-fit connection and, simultaneously, the power transmission between the coupling sleeve and the respective driven member may be effected by force-fit.

The circumstance, that the transmission means is selectively contactable directly with one of the coupling sleeves means that the transmission means may be brought into contact with the first, the second or none of the two coupling sleeves. Thus, there is no fixed contact between the transmission means an one or both of the coupling sleeves, but the transmission means contacts the respective coupling sleeve in the case of actuation and disengages completely therefrom if the coupling sleeve has to establish a force-fit between the drive shaft and the respective driven member.

As described above, due to the creation of high temperatures caused by the possibly large frictional heat between a coupling sleeve and the transmission means, care should be taken to manufacture the transmission means from a temperature-resistant material. In particular, a metal or a temperature-resistant plastic may serve this purpose. The latter is to be utilized in particular in the preferred embodiment in which, as the transmission means, the projection is integrally formed with the actuating element.

Regarding the coupling sleeves it is to be observed that they advantageously comprise a surface which the transmission means of the actuating element may come in contact with. Preferably, this contact surface is directly contactable from a housing-side direction of the electrical tool.

DETAILED DESCRIPTION OF THE PREFERRED EMBODIMENT

Figure 1:
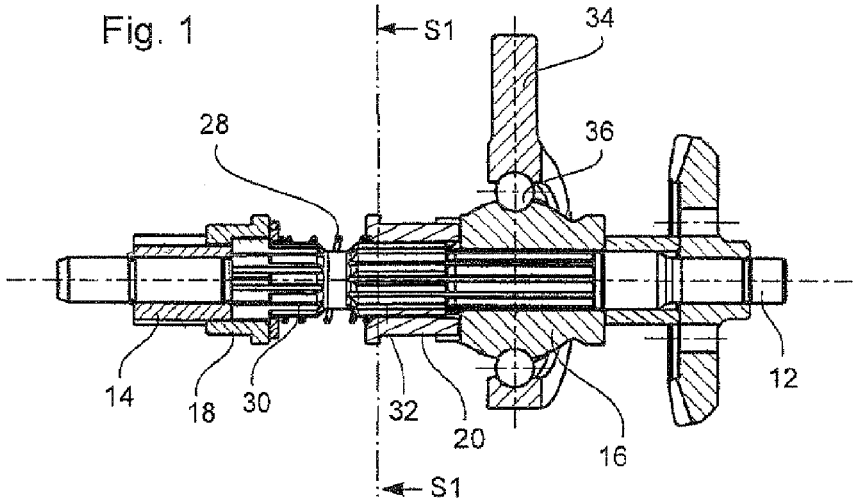
FIG. 1 shows a section of a gear switcher of an electrical tool in a preferred embodiment of the present invention, seen in a side sectional view.

FIG. 1 shows a gear shift mechanism in a preferred embodiment of an electrical tool according to the present invention in a side sectional view. A tumble drive hub 16, a countershaft gear 14, a first coupling sleeve 18 and a second coupling sleeve 20 are free-wheelingly supported on a horizontally arranged drive shaft 12. The two coupling sleeves 18, 20 are pressed apart and into engagement with the countershaft gear 14 and the tumble drive hub 16, respectively, by means of a biasing member, such as a helical spring 28. The helical spring 28 is free-wheelingly supported on the drive shaft 12 between the two coupling sleeves 18, 20.

Thus, the spring 28 engages the coupling sleeves 18, 20 and applies a force to the sleeves 18, 20 in opposite directions. In contrast to the countershaft gear 14 and the tumble drive hub 16, the coupling sleeves 18, 20 are form-fittingly connected to the drive shaft 12 through a splined connection or pinion contour 30, 32 of the drive shaft 12. A rotation of the drive shaft 12 thus directly leads to a rotation of both coupling sleeves 18, 20. FIG. 1 shows a state in which the coupling sleeves 18, 20 are, moreover, in form-fitting engagement with the countershaft gear 14 and the tumble drive hub 16, respectively.

In this state, in which the coupling sleeves 18, 20 are pressed by the helical spring 28, a rotation of the drive shaft 12 simultaneously leads to a rotation of the countershaft gear 14 and the tumble drive hub 16, too. An outer ring having a radially extending journal 34 is supported via a ball-bearing 36 on the tumble drive hub 16.

Figure 3:
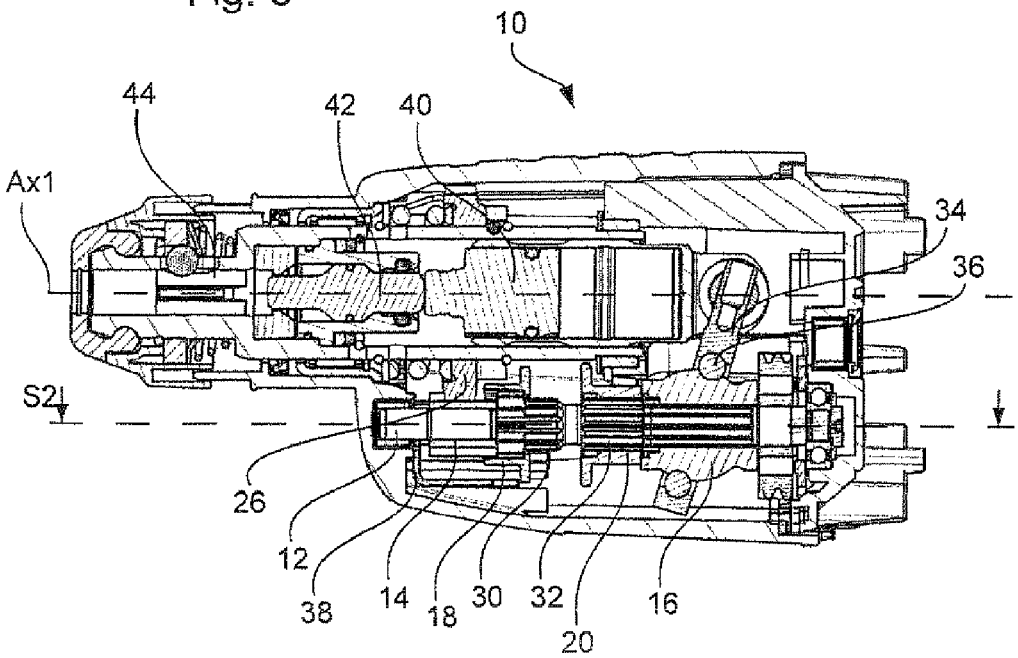
FIG. 3 shows a side sectional view of the electrical tool in a state in which the drive shaft is coupled with both driven members.

Upon rotation of the tumble drive hub 16, the journal 34 of the tumble drive, which is arranged in a linear guide, is moved backward and forward and effects an impact motion onto a tool clamped within a drill spindle 44 (FIG. 3, 5, 7). The countershaft gear 14 is rotationally coupled with the drill spindle 44 of the electrical tool 10 so that a rotation of the drive shaft 12 transferred to the countershaft gear 14 by means of the coupling sleeve 18 results in a rotation of the drill spindle 44.

Figure 2:
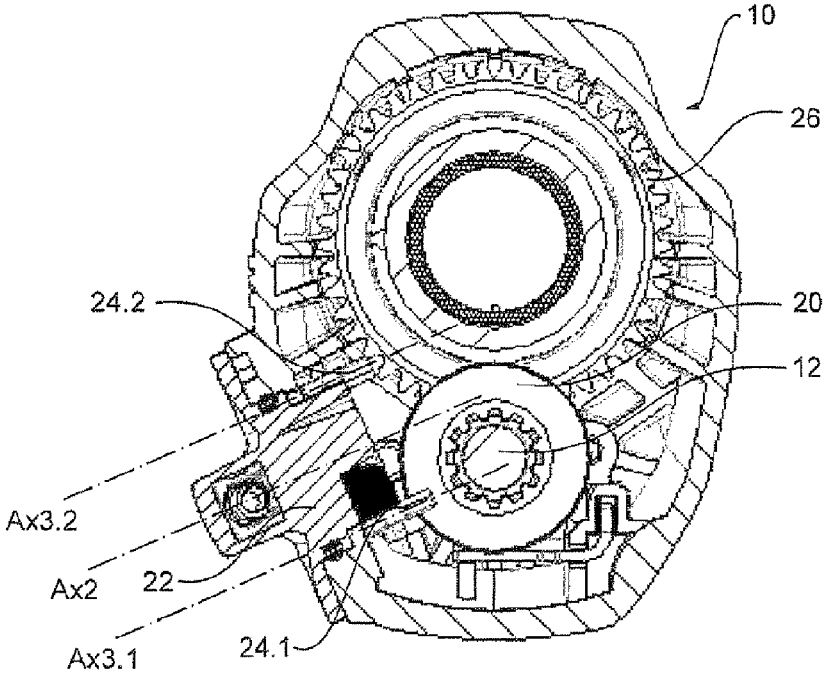
FIG. 2 shows a sectional view of the preferred electrical tool, wherein the section is made perpendicular to the alignment of the electrical tool along the sectional plane S1 and is shown from behind, along the drive shaft.

FIG. 2 shows a further sectional view of the electrical tool according to the preferred embodiment of FIG. 1. The section is made perpendicular to the drive shaft 12 at the height of the coupling sleeve 20 along the sectional plane S1, and is illustrated as a projection from behind, that is from the coupling sleeve 20 in direction of the coupling sleeve 18. Apart from the drive shaft 12 and the coupling sleeve 20, in this sectional view of the electrical tool 10, a stationary gear 26 can be seen which engages the countershaft gear 14 and transmits the rotational motion of the countershaft gear 14 onto the drill spindle 44.

This stationary gear 26 surrounds an axis Ax1 (FIG. 3, 5, 7) along which also the impact motion of the tumble drive is transmitted via an impact cylinder 40 to the tool chucked in the drill spindle 44, and around which the drill spindle 44 rotates. Moreover, FIG. 2 shows an actuating element 22 present in form of a rotary switch.

The rotary switch 22 comprises two pins 24.1, 24.2 which can be brought into contact with respective ones of the coupling sleeves 18, 20. In the state of the rotary switch 22 shown in FIG. 2, the first pin 24.1 is in contact with the coupling sleeve 20 by hitting against the overhanging region of the coupling sleeve 20 in a direction of the drive shaft 12 and thus displacing the coupling sleeve 20 along the drive shaft 12. The overhanging region of the coupling sleeve 20 is realized in rotational symmetry around the drive shaft 12 and constitutes a contact surface for pin 24.1. Due to the annular shape of the contact surface of the coupling sleeve 20, the coupling sleeve 20 can also rotate around drive shaft 12 without changing the contact between pin 24.1 and coupling sleeve 20.

The pin 24.1 is arranged and aligned such that it projects in a direction substantially parallel to rotational axis Ax2 of the rotary switch 22 and defines an axis Ax3.1 running substantially radially to the drive shaft 12. The same is true for the second pin 24.2, wherein the axis Ax3.2 defined by this pin is radially arranged to the drive shaft 12 only in a state of engagement with the coupling sleeve 18, not shown in FIG. 2. In the state shown in FIG. 2, the axis Ax3.2 runs in parallel to the rotational axis Ax2 of rotary switch 22 and the axis Ax3.1 defined by the first pin. The pins 24.1 and 24.2 together operate as a transmission portion of the rotary switch 22. That is, the pins 24.1 and 24.2 are configured to contact the sleeves 18, 20 and selectively move the sleeves 18, 20 to a desired position. Suitable alternative structures to the pins 24.1 and 24.2 can also be used to contact the sleeves 18, 20, as well.

FIG. 3 shows a side sectional view of the electrical tool of FIGS. 1 and 2. The shifting gear of FIG. 1 can be seen in the lower part of the electrical tool. The shifting gear is in the same state as FIG. 1 so that a detailed description of the elements used is unnecessary here. In addition to FIG. 1, FIG. 3 shows a further flow of force from the tumble drive hub 16 and the countershaft gear 14, respectively.

Further, a locking plate 38 can be seen which, however, does not serve a locking function in the state shown in FIG. 3. In the state shown in FIG. 3, the drive shaft 12 serves both for driving the tumble drive hub 16 and for driving the countershaft gear 14. Upon its rotation, the tumble drive hub 16 causes a forward and backward impact motion of the tumble drive journal 34, which is supported on the tumble drive hub 16 via ball bearing 36 and is guided in a linear guide running parallel to the drive shaft 12. The forward and backward motion of journal 34 is propagated to an impact cylinder 40 guided in an impact guide, wherein the impact guide extends in a direction parallel to drive axis 12 along axis Ax1. Upon forward motion of the tumble drive journal 34 the impact cylinder 40 hits upon a snap die 42 which in turn transmits the impact force onto a tool chucked within a drill spindle 44.

In parallel to this impact motion of the tumble drive journal 34, the impact cylinder 40 and the snap die 42, the rotation of the drive shaft 12 leads to a rotation of the countershaft gear 14 which engages the stationary gear 26. The stationary gear 26 surrounds an impact axis Ax1 of the electrical tool 10 and the impact cylinder 40 and snap die 42 arranged therein. The drill spindle 44 is wedged with the stationary gear 26 so that the rotational motion of the gear 26 also rotates the drill spindle 44 and the tool chucked therein, independent from the tool in the drill spindle 44 being acted upon by the impact cylinder 40 and the snap die 42.

The state of the electrical tool 10 shown in FIG. 3 thus corresponds to the combined drill and chisel operation of the electrical tool 10 in which a tool chucked within the drill spindle 44 is, on the one hand, driven to perform a drill motion and, on the other hand, acted upon by impact forces from behind.

Figure 4:
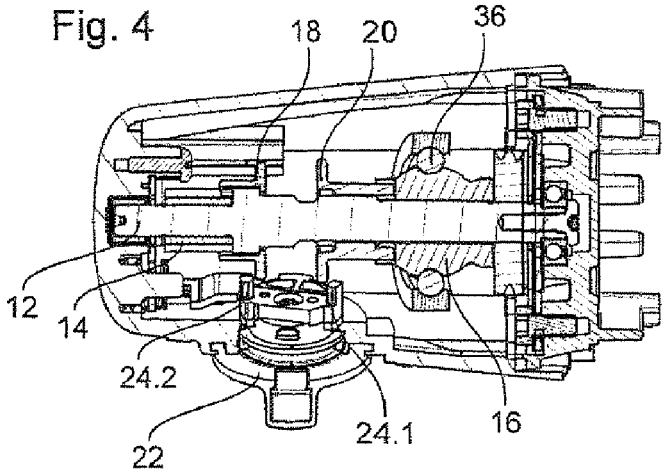
FIG. 4 shows a top sectional view along the sectional plane S2 of the electrical tool of FIG. 3.

FIG. 4 shows a further sectional view along a sectional plane S2 in FIG. 3. Thus, a top view of a sectional representation is shown, wherein the section runs along the drive shaft 12. Just as in FIGS. 1 and 3, the drive shaft 12, the countershaft gear 14, the tumble drive hub 16 and the coupling sleeves 18 and 20 are shown in FIG. 4, too. In addition to what is illustrated in FIG. 3, FIG. 4 shows the rotary switch 22 already shown in FIG. 2.

The rotary switch 22 is provided with two pins 24.1, 24.2 which are both disengaged from the respective coupling sleeves 20, 18. In the state of the electrical tool 10 illustrated in FIGS. 3 and 4, the coupling sleeves 18, 20 are also engaged with their corresponding driven member, the countershaft gear 14 and the tumble drive hub 16, respectively, since none of the pins 24.1, 24.2 of the rotary switch 22 is in contact with one of the coupling sleeves 18, 20 and contrasts the force acting upon coupling sleeves 18, 20. FIG. 4 thus shows the position of the rotary switch 22, which allows a combined drill and chiselling operation of the electrical tool 10.

Figure 5:
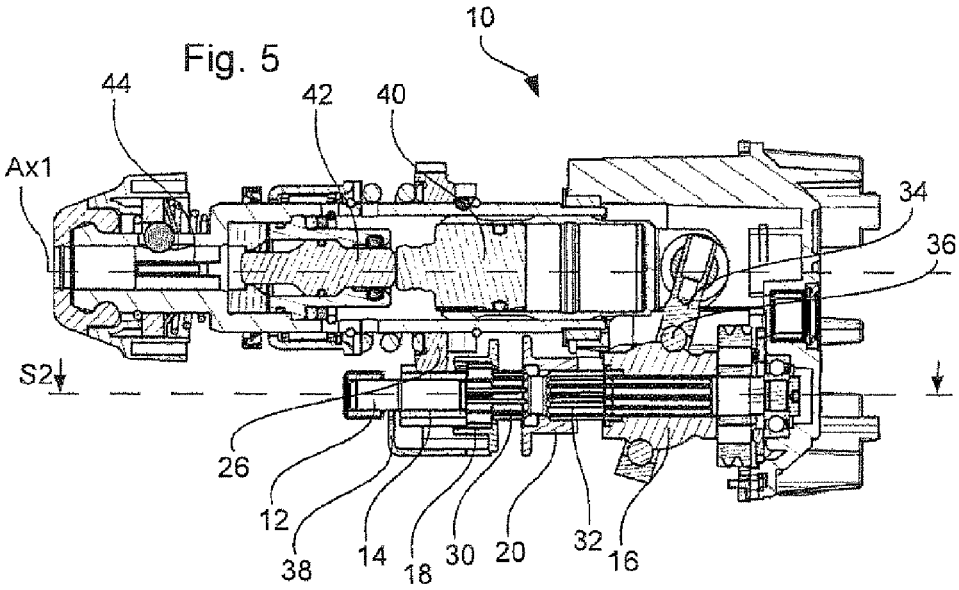
FIG. 5 shows the electrical tool of FIG. 3 in a side sectional view, wherein a flow of force between the drive shaft and a tumble drive is interrupted.

FIG. 5 shows the view of FIG. 3 of the electrical tool 10 according to the preferred embodiment of the invention. In contrast to FIG. 3 however, FIG. 5 shows a state in which the coupling sleeve 20 provided for transmitting the drive force of the drive shaft 12 onto the tumble drive hub 16 is decoupled. In the state illustrated in FIG. 5, the coupling sleeve 20 is displaced to the left, in a direction towards the coupling sleeve 18.

In this way, the coupling sleeve 20 is still in form-fitting connection with the drive shaft 12, but the tumble drive hub 16 is not connected with the coupling sleeve 20 and thus lies free-wheelingly on the drive shaft 12. This means that the rotation of the drive shaft 12 results in a rotational motion of the countershaft gear 14 and, thus, the stationary gear 26 and the drill spindle 44; but apart from this motion employed for the drill operation of the electrical tool 10, no impact motion of the tumble drive journal 34, the impact cylinder 40 and the snap die 42 is effected. If the coupling sleeve 20 is decoupled, the electrical tool 10 is thus in a pure drill mode without simultaneously performing a chiselling function.

Figure 6:
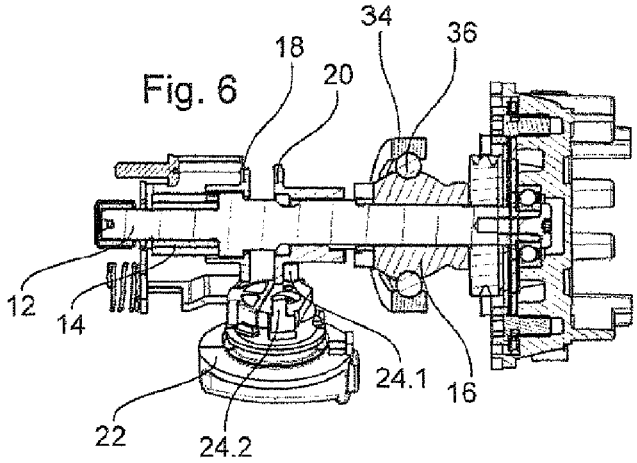
FIG. 6 shows the electrical tool of FIG. 5 in a top sectional view along sectional plane S2.

FIG. 6 corresponds to the view of FIG. 4 of the electrical tool 10, in a state as shown in FIG. 5. It can be clearly seen that the rotary switch 22 acts onto the coupling sleeve 20 through pin 24.1 which is fixed on the rotary switch 22. Here, the second pin 24.2 of the rotary switch 22 is not in engagement with the coupling sleeve 18 so that the force transmission between the drive shaft 12 and the countershaft gear 14 via coupling sleeve 18 is ensured. The state of the electrical tool shown in FIGS. 5 and 6 corresponds to a rotation of rotary switch 22 from the combined drill and chiselling position by 90° to the right and, thus, deactivates the chiselling function of the electrical tool.

Figure 7:
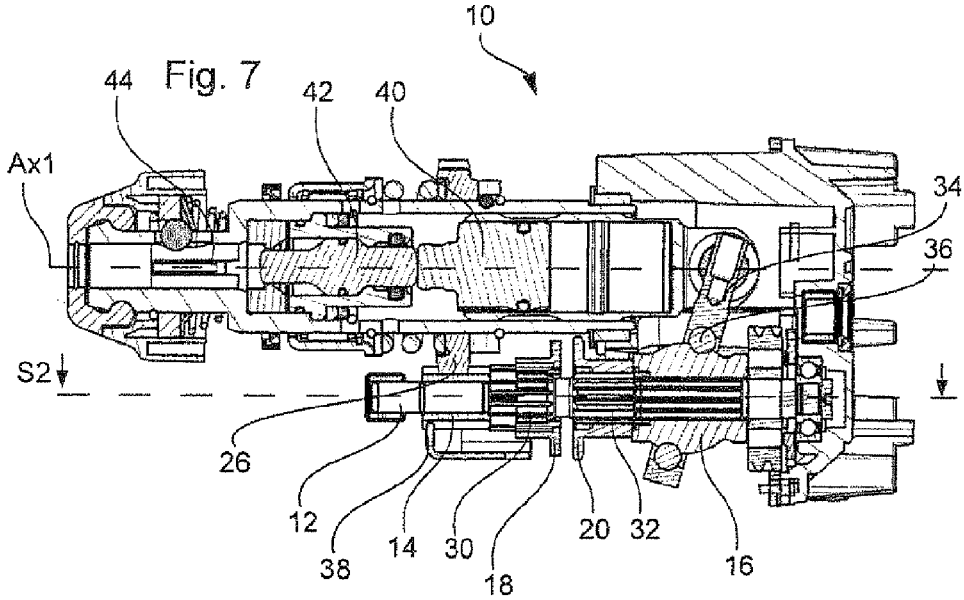
FIG. 7 shows the electrical tools of FIGS. 3 and 5 in a side sectional view, wherein a flow of force between the drive shaft and a counter shaft is interrupted.

FIG. 7 shows the electrical tool 10 in the same view as FIGS. 3 and 5, but in a state in which the coupling sleeve 20 is in engagement with the tumble drive hub 16, but the coupling sleeve 18 is disengaged from the countershaft gear 14. In the state illustrated in FIG. 7, the coupling sleeve 18 is displaced to the right, in a direction towards the coupling sleeve 20.

In this way, the coupling sleeve 18 is still form-fittingly connected with the drive shaft 12, but the countershaft gear 14 is not connected with the coupling sleeve 18 and is, thus, arranged free-wheelingly on the drive shaft 12. Moreover, in the state of the electrical tool 10 shown in FIG. 7, the locking plate 38 is in engagement with the countershaft gear 14 in order to lock it. The locking plate 38 is acted upon by a biasing member such as a spring (not shown) in direction of the coupling sleeve 20.

The locking plate constitutes a third coupling element in analogy to the two coupling sleeves 18 and 20. Thus, by means of the actuating element 22, three coupling elements 18, 20 and 38 are brought directly into engagement, without a further intermediate switching element, in order to realize the three operating modes of the electrical tool.

The rotary switch 22, not shown in FIG. 7, keeps the locking plate 38 disengaged from the countershaft gear 14, both in the combined drill and chiselling operating mode and in the pure drill mode of the electrical tool, and allows a locking of the countershaft gear 14 only in the case of decoupling the coupling sleeve 18. In the case of this decoupling of the coupling sleeve 18, the countershaft gear 14 is decoupled from the rotational motion of the drive shaft 12 so that the drive shaft 12 is rotatable independently of the locking of the countershaft gear 14. By locking the countershaft gear 14 through the locking plate 38, a rotation of the drill spindle 44 is prevented, too, so that a tool chucked within the drill spindle 44 cannot be rotated around axis Ax1. However, FIG. 7 also shows that the coupling sleeve 20 is engaged with tumble drive hub 16. Thus, in the state of the electrical tool 10 shown in FIG. 7, the tumble drive operation is effected by means of tumble drive hub 16, ball-bearing 36 and tumble drive journal 34 and results in an impact motion of the impact cylinder 40 and the snap die 42 onto the tool chucked within drill spindle 44. Consequently, FIG. 7 shows a pure chiselling mode of the electrical tool 10.

Figure 8:
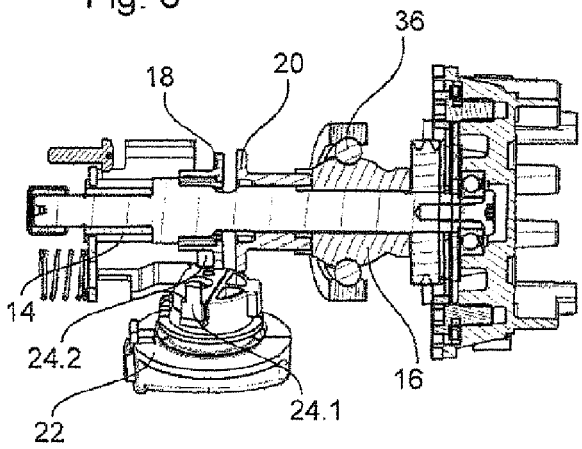
FIG. 8 shows a top sectional tool along sectional plane S2 of the electrical tool of FIG. 7.

Similarly, in FIG. 8 which corresponds to the view of FIGS. 4 and 6, a rotary switch 22 is shown, the second pin 24.2 of which is in contact with coupling sleeve 18. In analogy to the state of the electrical tool 10 shown in FIG. 6, the coupling sleeve 18 is disengaged from the countershaft gear 14 by the contact between pin 24.2 and the overhanging portion of the coupling sleeve 18. Here, coupling sleeve 20 is not contacted by pin 24.1 of rotary knob 22 and is, thus, in engagement with tumble drive hub 16.

Apart from the embodiment shown in FIGS. 1 through 8, an electrical tool is conceivable, which merely comprises one coupling sleeve. In this case it is sufficient if the rotary switch 22 comprises a single pin which is contactable with the coupling sleeve. Besides, in an embodiment of the electrical tool having two coupling sleeves, it is also possible to provide merely one projection instead of two pins 24.1, 24.2, which extends between the two positions of pins 24.1, 24.2.

As can be seen in FIGS. 4, 6 and 8, the rotary switch 22 is implemented as a substantially circular element which has a grip portion on its outwardly directed part for rotating the rotary switch. The two pins 24.1, 24.2 are provided on the inwardly projecting part of the rotary switch 22 on its innermost surface.

In the embodiment illustrated here, these pins are fitted into the body of the rotary switch 22. In contrast and preferably, it is also possible to form the pins 24.1, 24.2 integrally with the rotary switch 22. Moreover, the inward facing part of the rotary switch 22 has a substantially cylindrical form, wherein a part of the cylindrical portion is cut away in the shape of a secant. In this way, a flat contact surface is created which is formed on a side of the inwardly protruding part of the rotary knob 22. In this angle range, the peripheral surface of the inwardly projecting part of the rotary switch 22 does not have the form of a cylinder barrel but is planar. In the state of the electrical tool shown in FIGS. 7 and 8, that is upon decoupling the coupling sleeve 18, this planar surface faces the locking plate 38 such that this locking plate 38 acted upon by a spring force is displaceable to the right, that is in direction of coupling sleeves 18 and 20, since the locking plate 38 would otherwise abut against the cylinder barrel-shaped part of the rotary switch 22, not present in the angle range of the secant-shaped plane. In this way, it is ensured that an engagement of the locking plate 38 with the countershaft gear 14 only occurs in the decoupled state of the countershaft gear 14.

What is claimed is:

1. An electrical tool, comprising a drive shaft and a pair of driven members, wherein the drive shaft is selectively connectable to the driven members by a respective one of a pair of coupling sleeves, wherein the coupling sleeves are actuated through a rotatable mechanical actuating element, wherein the actuating element comprises a transmission portion stationary with respect to the actuating element, the transmission portion directly contacting the respective coupling sleeve, wherein at least one of the driven members is selectively locked against a rotational motion by a locking device that is biased toward a locked position, wherein the actuating element and the locking device cooperate in direct contact with each other to move the locking device to an unlocked position and allow the locking device to move to the locked position, wherein the driven members are a countershaft gear and a tumble drive hub, and wherein the actuating element alternatively switches between a first state, in which the electrical tool performs a rotational motion of the countershaft gear without moving the tumble drive hub, a second state in which the electrical tool performs a motion of the tumble drive hub with the countershaft gear being rotationally fixed by the locking device, and a third state in which the electrical tool performs a simultaneous motion of the countershaft gear and the tumble drive hub.

2. The electrical tool of claim 1, wherein the locking device is biased by a spring force in the direction in which one of the coupling sleeves is moved when the actuating element is rotated in a first direction.

3. The electrical tool of claim 1, wherein the actuating element comprises a planar contact surface that allows the locking device to be movable in a direction of the coupling sleeves when the planar contact surface is aligned with the locking device, wherein the locking device is otherwise supported against a portion of the actuating element other than the planar contact surface.

4. The electrical tool of claim 1, wherein the coupling sleeves are supported on the drive shaft in an axially displaceable manner.

5. The electrical tool of claim 1, wherein the driven members are free-wheelingly supported on the drive shaft.

6. The electrical tool of claim 1, wherein the coupling sleeves are configured for each establishing a form-fitting operative connection between the drive shaft and the driven members.

7. The electrical tool of claim 1, wherein the coupling sleeves are each acted upon in the direction of first position in which the drive shaft and the respective driven member are in operative connection with each other, wherein the respective first positions are axially opposite to each other.

8. The electrical tool of claim 7, wherein the coupling sleeves are positionable in respective second positions by the actuating element via the transmission portion in which the drive shaft and the respective driven member are not operatively connected with each other.

9. The electrical tool of claim 1, wherein the transmission portion is formed by at least one projection, wherein the projection extends in a direction substantially parallel to the rotational axis of the actuating element.

10. The electrical tool of claim 9, wherein the projection in one of the contact positions with one of the coupling sleeves extends substantially along an axis running radially to the drive shaft.

11. The electrical tool of claim 9, wherein the projection is formed by a pin that is integrally formed with the actuating element.

12. The electrical tool of claim 1, wherein the rotational axis of the actuating element runs substantially in parallel to the radial axis of the drive shaft.

13. The electrical tool of claim 1, wherein the electrical tool is a drill and chiselling hammer.

14. The electrical tool of claim 1, wherein the rotatable mechanical actuating element is a mechanical rotary switch.

* * * * *